United States Patent [19]

Lottridge

[11] 3,962,026

[45] June 8, 1976

[54] ORGANIC MATRIX STACKING HEAD

[75] Inventor: Lawrence A. Lottridge, Windsor, Conn.

[73] Assignee: United Technologies Corporation, Hartford, Conn.

[22] Filed: June 25, 1975

[21] Appl. No.: 590,277

[52] U.S. Cl. ..... 156/584; 29/200 D; 29/427; 33/1 M; 74/471 X Y

[51] Int. Cl.[2] ..... B32B 31/00; G05G 9/00

[58] Field of Search ..... 156/584, 581; 74/471 X Y; 33/1 M; 29/239, 200 D, 427

[56] References Cited

UNITED STATES PATENTS

| | | | |
|---|---|---|---|
| 3,241,243 | 3/1966 | Speer | 33/1 M |
| 3,384,970 | 5/1968 | Avalear | 74/471 XY |
| 3,774,311 | 11/1973 | Stemple | 33/1 M |

*Primary Examiner*—Douglas J. Drummond
*Attorney, Agent, or Firm*—John D. Del Ponti

[57] ABSTRACT

A pick-up head for the manipulation of workpieces comprised of tacky material includes a rocker foot capable of four degrees of motion. The pick-up head is mounted on a horizontally movable carriage and includes controllable apparatus for causing the rocker foot to rotate, reciprocate vertically with respect to a table on which the workpieces are positioned and to translate with respect to the remainder of the pick-up head. Horizontal movement of the pick-up head subsequent to establishment of initial contact between the curved rocker foot and a workpiece results in the area of contact between the workpiece and foot increasing and the workpiece may thus be "peeled" from the table or other supporting medium.

12 Claims, 1 Drawing Figure

ORGANIC MATRIX STACKING HEAD

BACKGROUND OF THE INVENTION:

1. Field of the invention

The present invention relates to composite materials and particularly to the fabrication of articles from laminates wherein each layer is a composite consisting of uniformly distributed fibers captured in a matrix material. More specifically, this invention is directed to techniques for the manipulation of mono and multilayer composite tapes, which tapes include a resinous matrix material in the uncured state, to achieve the stacking of such composite tapes as a step in the fabrication of usable structures therefrom. Accordingly, the general objects of the present invention are to provide novel and improved methods and apparatus of such character.

2. Description of the prior art

A novel method for the handling of pre-impregnated composite tapes is disclosed in copending U.S. Patent application Ser. No. 573,040 of E. R. More and H. A. Nutter, Jr. filed Apr. 30, 1975 and assigned to the assignee of the present invention. The disclosure of application Ser. No. 573,040 is incorporated into the disclosure of the present application by reference.

To briefly summarize the method of application Ser. No. 573,040, the composite in sheet or tape form, with the resinous matrix material in an uncured state, is sandwiched between liners and positioned on a cutting table. A numerical tape controlled reciprocating cutter thereafter generates the desired ply shapes; the layers of the desired end product thus being formed in place and in accordance with a predetermined distribution pattern. Subsequent to ply generation, the upper liner is stripped from the composite material to expose the tacky upper surface of the composite material. Thereafter a ply stacking operation is performed. During the course of this ply stacking operation an automatic stacking heat is employed to pick up and compact the plies in sequence with each subsequently picked up piece of pre-impregnated composite tape being oriented such that pieces are in their designated and required location relative to one another. During the stacking procedure, which deposits the plies on the pick-up head, the adhesive tack of the exposed upper ply surfaces is utilized to achieve ply-to-ply adherence and the lower liner will remain on the cutting table since the adhesive attraction between plies of the composite is greater than that between the composite and lower liner while the holding force, usually a vacuum, between the lower liner and the table is greater than the adhesive attraction of the lower liner to the resin. After stacking has been completed the precision stacked plies are removed from the pick-up head for final compaction and curing.

The initially utilized stacking head employed a foot which descended over the selected ply and lifted it vertically from the table surface. As a result of the high relative bond strength between the composite and lower liner, unsatisfactory results have often been achieved using a direct vertical lift.

SUMMARY OF THE INVENTION

The present invention overcomes the above briefly discussed and other deficiencies and disadvantages of the prior art by providing a novel pick-up head for the manipulation of pre-impregnated composite tapes having a tacky resinous matrix material. The apparatus of the present invention consists of a rocker mechanism pick-up foot which is affixed to a pick-up head. The pick-up head is mounted for indexing in the X and Y directions and the rocker foot may be translated, rotated and vertically reciprocated. The configuration of the pick-up foot is such that, subsequent to initial contact of the foot with the tacky surface of the composite material, horizontal movement may be imparted to the head whereby the foot will transcribe a rocking motion as it traverses the composite. Restated, contact between a curved lower surface of the pick-up foot and the composite is initially established only along a narrow region of the ply to be picked up, this contact region generally being along an edge of the ply. Horizontal motion of the pick-up head subsequent to establishment of initial contact between the foot and composite will result in the area of contact between the foot and composite tape increasing and the ply will be "peeled" from a lower liner starting from the region of initial contact between the foot and composite

BRIEF DESCRIPTION OF THE DRAWING

The present invention may be better understood and its numerous objects and advantages will become apparent to those skilled in the art by reference to the accompanying drawing which is a side elevation view, partially in section, of a pick-up head in accordance with a preferred embodiment of the invention.

DESCRIPTION OF THE PREFERRED EMBODIMENT

Figure 1:
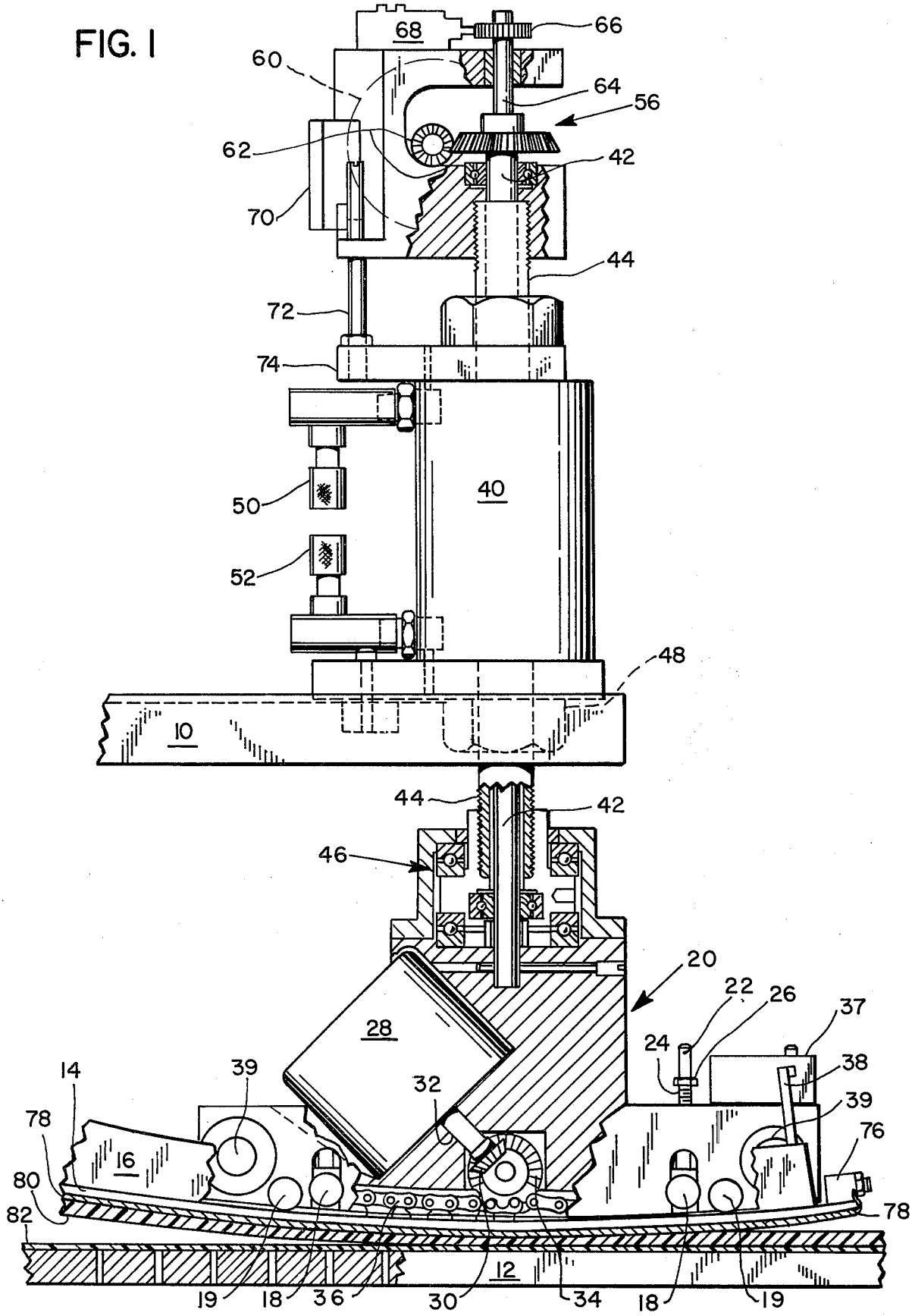

With reference to the drawing, the pick-up head is mounted from a movable carriage 10. Carriage 10 forms a portion of a numerically controlled indexing mechanism which is capable of movement with respect to the surface of a work table 12. Table 12 is typically a vacuum table and carriage 10 is movable in the X and Y directions under the authority of a programmable controller. Carriage 10 may, for example, be a component of a commercially available X-Y plotting table employing a digital step-motor drive. Plotting tables suitable for use with the present invention are available from, among other sources, The Gerber Scientific Instrument Company of South Windsor, Conn. and such tables may be mated with a general purpose digital computer and tape reader in order to achieve the requisite control over the movements of carriage 10.

The pick-up head of the present invention is rigidly mounted on carriage 10. The pick-up head includes a curved elongated rocker member or foot 14. The upper side of rocker foot 14 is provided, along its opposite longer edges, with a pair of facing L-shaped cam track defining members 16. The curved facing tracks defined by members 16 receive roller type cam followers such as adjustable followers 18 and fixed position followers 19. The cam followers 18 and 19 are supported from the body, indicated generally at 20, of the pick-up head. The mounting means for adjustable cam followers 18 includes take-up rods 22, Belleville washers 24 and adjusting nuts 26. Cam followers 19 contact the bottom of the cam tracks while followers 18 may be adjusted to contact the tops of the cam tracks. The provision for adjustment of followers 18 is in the interest of eliminating any vertical looseness between foot 14 and body 20.

The pick-up head rocker foot 14 is capable, in the manner to be described below, of four types of motion, i.e., vertical, rotary, translational and rocking motion. The means by which the translational motion is accomplished includes a reversible stepping motor 28. A miter gear 30 is affixed to the output shaft 32 of motor 28. Gear 30 engages and drives a sprocket 34. Sprocket 34, in turn, engages a roller chain 36 which is affixed, by any suitable means, to the upper side of the rocker foot 14 between the cam track defining members 16.

Energization of motor 28 will produce relative or translational motion between the body and work engaging rocker foot portions of the pick-up head. Movement of carriage 10 in a horizontal plane, because the axes of rotation of the cam followers 18 and 19 are constrained to movement only in planes parallel to the surface of table 12, results in a rocking motion being imparted to the rocker shoe 14. The means by which the vertical and rotational motion of the pick-up head and rocker foot are achieved will be discussed below.

Considering further the translational motion, motor 28 will ordinarily be energized only when the head is in the raised position. When motor 28 is energized the foot 14 will move relative to body 20 until a microswitch 37 is activated by a cam 38; the operation of switch 37 signifying the achievement of the translational reference position from which motor 28 can drive the foot 14 to the selected translation position. When translating, the rocker foot 14 rides on four ball-type casters. The casters, two of which are indicated at 39, are mounted on body 20 by means of conventional springs and sleeves in the interest of eliminating any side-to-side looseness between rocker foot 14 and body 20.

The pick-up head body 20 and the components mounted therefrom are, as briefly noted above, capable of reciprocating motion transverse to the plane of table 12. This reciprocating movement is achieved through the use of an air cylinder 40 mounted above carriage 10. Air cylinder 40 is of the type having a unitary output shaft 44 which extends out of both ends thereof; a piston being mounted on shaft 44 within the cylinder. The air cylinder output shaft 44 is capable of only reciprocating motion. The downwardly extending portion of the air cylinder output shaft 44 is attached to body portion 20 of the pick-up head through thrust bearings 46. Air cylinder 40 is fixedly mounted to carriage 10 by means of a nut 48. Fluid is delivered to and received from the air cylinder 40 via connections, not shown, made to flow control valves 50 and 52. Thus, by controlling the pressure at the opposite ends of the air cylinder a pressure differential may be selectively established to raise or lower the pick-up head relative to the work table.

A rocker foot rotation drive shaft 42 passes through and is coaxial with the air cylinder output drive shaft 44. Rotation drive shaft 42 is coupled to a rotary drive mechanism indicated generally at 56. The rotary drive mechanism 56 is mounted on the top of the air cylinder drive shaft 44 and thus will move vertically with shaft 44. The rotary drive includes a stepping motor 60 which drives, through a set of anti-backlash miter gears 62, the foot rotation shaft 42. An extension 64 of the foot rotation shaft 42 is provided with a cam 66 which contacts and operates the plunger of a micro-switch 68. Switch 68 may thus provide an output signal commensurate with a rotational reference point of the pick-up head. The output from switch 68 may be applied to a programmed sensor whereby a signal commensurate with the rocker foot reaching its rotational reference position may be provided for use by the control computer.

It is to be noted that rotational adjustments of the position of the pick-up head may be affected only when the head is in the raised position. A further microswitch 70, activated by the upper end of a guide pin 72 mounted on a bracket 74, provides a signal indicating that the pick-up head is in its raised position. The signal from switch 70 is used by the control computer to prevent rotation of the pick-up head when the foot 14 is lowered to table 12. The signal from switch 70 is also employed by the control computer to prevent translation of the carriage assembly until the foot 14 is clear of the table 12.

In order to facilitate removal of tacky material from the lower surface of the rocker foot 14 of the pick-up head, the opposite ends of foot 14 may be provided with clamps such as indicated at 76. The clamps 76 will engage and hold a sheet 78 of metal foil or other suitable material tightly against the lower surface of rocker foot 14. Material adhering to the pick-up foot, and more precisely to the sheet 78, may be removed from the foot with sheet 78 and be inspected and manipulated without the necessity of touching the tacky composite material in its uncured state. Following inspection the ply stack may be removed from sheet 78 and processed.

In operation, with the pick-foot raised above the work table, the motor 28 will be energized to drive the rocker foot 14 to a first limit position as, for example, determined by switch 37. Thereafter, under computer control, the carriage 10 will be indexed so as to place the pick-up head directly above the ply to be picked up off the work table 12. With the pick-up head positioned directly over the selected ply the head is rotated by stepping motor 60 to the angular position required to pick up the intended ply. The foot 14 is then translated by stepping motor 28 to the proper starting position. Next, the air cylinder 40 will be energized to cause the pick-up head to descend thus bringing the rocker foot 14 into contact with the tacky surface of the preimpregnated composite material which has been indicated at 80. Because of the curved configuration of rocker foot 14, contact with the ply will be initially established only along a narrow band or line which will typically be adjacent to a first edge or corner of the ply. With motor 28 deenergized, the body portion 20 of the pick-up head and all components mounted therefrom will be moved in concert with carriage 10 of the plotting table. Since the carriage 10 constrains the motion of the cam followers 18 and 19 to be in horizontal planes, the longitudinal movement of the pick-up head body parallel to the table 12 with the carriage 10 will impart a rocking motion to foot 14 whereby the area of contact with the uncured resinous composite comprising the ply will move across the ply. During this movement the band or line of initial contact with the ply will be lifted upwardly and thus the ply will be peeled from the lower liner 82 which is in contact with the surface of the work table.

When the degree of movement necessary to completely peel a first ply from the lower liner and table has been completed, the air cylinder 40 will be energized in the opposite direction to raise the pick-up head. Thereafter, the motor 28 will be reenergized to return the rocker foot 14 and body 20 to their initial relative positions and the carriage 10 will be moved to position the pick-up head over a next successive ply which is to be added to the stack on the rocker foot. If the orientation of filaments in the succeeding ply is to be different from that in the immediately preceding ply, the motor 60 will be energized to readjust the angular position of the pick-up head. Thereafter, the translationing and peeling operation will be repeated as above described.

It is to be recognized that a plurality of ply stacks may be formed on the pick-up head rocker foot 14 at one time. This may be accomplished by picking up a first ply of a first stack at a first position on the rocker foot 14 and thereafter the first ply of a second stack may be caused to adhere to and be picked up at a second laterally displaced position on the rocker foot 14. The plural stacks may thus be built up sequentially in the manner described above for a single stack.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for use in the manipulation of workpieces which are temporarily adhesively bonded to a planar supporting medium comprising:

rocker foot means, said rocker foot means having a curved surface adapted to contact a workpiece to be removed from the support medium initially in a narrow linear region;

support means for said rocker foot means, said support means permitting translational motion of said rocker foot means with respect to said support means;

means for mounting said support means for motion in a plane transverse to the supporting medium;

means for reciprocating said support means with respect to said mounting means and the supporting medium; and means for imparting rotation to said support means.

2. The apparatus of claim 1 wherein said rocker foot means comprises:

a curved rocker foot; and curved cam track defining members affixed to the side of said rocker foot disposed away from the workpiece contacting surface thereof.

3. The apparatus of claim 2 wherein said support means comprises:

a body;

cam means mounted on said body and engaging the cam tracks formed by said rocker foot means cam track defining members; and bearing means for supporting said body from said reciprocating means.

4. The apparatus of claim 3 wherein said support means further comprises:

a motor mounted on said body;

a drive chain affixed to the same side of said rocker foot as said cam track defining members; and sprocket means driven by said motor and engaging said chain, energization of said motor imparting translational motion with respect to said support means body to said rocker foot means.

5. The apparatus of claim 3 wherein said reciprocating means comprises:

a fluid operated actuator, said actuator being mounted on said mounting means and having an output piston rod connected to said support means body through said bearing means.

6. The apparatus of claim 4 wherein said reciprocating means comprises:

a fluid operated actuator, said actuator being mounted on said mounting means and having an output piston rod connected to said support means body through said bearing means.

7. The apparatus of claim 5 wherein said rotation imparting means includes:

a foot rotation drive shaft, said drive shaft being coaxial with said actuator piston rod and being directly connected to said rocker foot means body; and motor means for causing rotation of said drive shaft, said motor means being mounted for reciprocation with said rocker foot means body.

8. The apparatus of claim 6 wherein said rotation imparting means includes:

a foot rotation drive shaft, said drive shaft being coaxial with said actuator piston rod and being directly connected to said rocker foot means body; and motor means for causing rotation of said drive shaft, said motor means being mounted for reciprocation with said rocker foot means body.

9. The apparatus of claim 3 further comprising:

clamp means for attaching a releasable sheet of material to the work engaging surface of said rocker foot.

10. The apparatus of claim 7 further comprising:

clamp means for attaching a releasable sheet of material to the work engaging surface of said rocker foot.

11. The apparatus of claim 10 further comprising:

means mounted on said rocker foot means body for providing an indication of said rocker foot reaching a first limit of travel during translational motion.

12. The apparatus of claim 11 further comprising:

means for providing an indication of the rotational position of said rocker foot.

* * * * *

UNITED STATES PATENT OFFICE

CERTIFICATE OF CORRECTION

PATENT NO. : 3,962,026

DATED : June 8, 1976

INVENTOR(S) : Lawrence A. Lottridge

It is certified that error appears in the above-identified patent and that said Letters Patent are hereby corrected as shown below:

After the "Abstract" insert -- The invention herein described was made in the course of or under a contract or subcontract thereunder, with the Department of the Air Force. --

Column 1, line 40 "heat" should be -- head --

Signed and Sealed this

Seventh Day of September 1976

[SEAL]

*Attest:*

RUTH C. MASON
*Attesting Officer*

C. MARSHALL DANN
*Commissioner of Patents and Trademarks*